US005934248A

United States Patent [19]

Toyoda

[11] Patent Number: 5,934,248

[45] Date of Patent: Aug. 10, 1999

[54] AIR-FUEL RATIO CONTROLLER FOR INTERNAL COMBUSTION ENGINE

[75] Inventor: Katsuhiko Toyoda, Shizuoka-ken, Japan

[73] Assignee: Suzuki Motor Corporation, Hamamatsu, Japan

[21] Appl. No.: 09/123,819

[22] Filed: Jul. 28, 1998

[30] Foreign Application Priority Data

Jul. 31, 1997 [JP] Japan ..... 9-220205

[51] Int. Cl.[6] ..... F02M 3/00

[52] U.S. Cl. ..... 123/339.12; 123/339.22; 123/674; 123/680

[58] Field of Search ..... 123/339.12, 339.22, 123/339.24, 674, 680; 701/104, 109

[56] References Cited

U.S. PATENT DOCUMENTS

| | | | |
|---|---|---|---|
| 4,747,379 | 5/1988 | Oba | 123/339.24 |
| 4,864,997 | 9/1989 | Miyachi | 123/674 |
| 5,269,272 | 12/1993 | Nakaniwa | 123/339.22 |
| 5,337,557 | 8/1994 | Toyoda | 60/276 |
| 5,722,368 | 3/1998 | Sakai | 123/339.23 |

FOREIGN PATENT DOCUMENTS

| | | |
|---|---|---|
| 5-133262 | 5/1993 | Japan . |
| 5-222973 | 8/1993 | Japan . |
| 6-249019 | 9/1994 | Japan . |

*Primary Examiner*—Tony M. Argenbright
*Assistant Examiner*—Mahmoud M. Gimie
*Attorney, Agent, or Firm*—Flynn, Thiel, Boutell & Tanis, P.C.

[57] ABSTRACT

An air-fuel ratio controller for an internal combustion engine, which controller is capable of: properly correcting an air-fuel ratio after a start-up explosion; preventing inconveniences such as occurrence of an engine stall, a decrease in an engine rotational speed, and a discharge of exhaust gases containing harmful components; and, allocating an idle time-learning value with reference to a rotational engine speed that is obtained at the time of engine start-up, thereby enhancing convenience of use. To this end, the air-fuel ratio controller is provided with an additional feature whereby it is determined, in executing a rotational engine speed-determining item of an idle time-learning region condition, that the rotational engine speed-determining item is satisfied when a rotational engine speed is equal to or less than a value obtained by addition of an ISC target rotational speed and a predetermined value, the predetermined value including either a fixed value or a variable value, the variable value being mapped on a table for each water temperature.

7 Claims, 8 Drawing Sheets

FIG. 6
IDLE TIME AIR-FUEL RATIO-LEARNING
(1) AIR-CONDITIONER OFF (2) AIR-CONDITIONER ON
| ENGINE LOAD | $Q_1$ | $Q_2$ | | $Q_n$ |
|---|---|---|---|---|
| AIR-FUEL RATIO LEARNING VALUE | $IL_1$ | $IL_2$ | | $IL_n$ |
FIG. 7
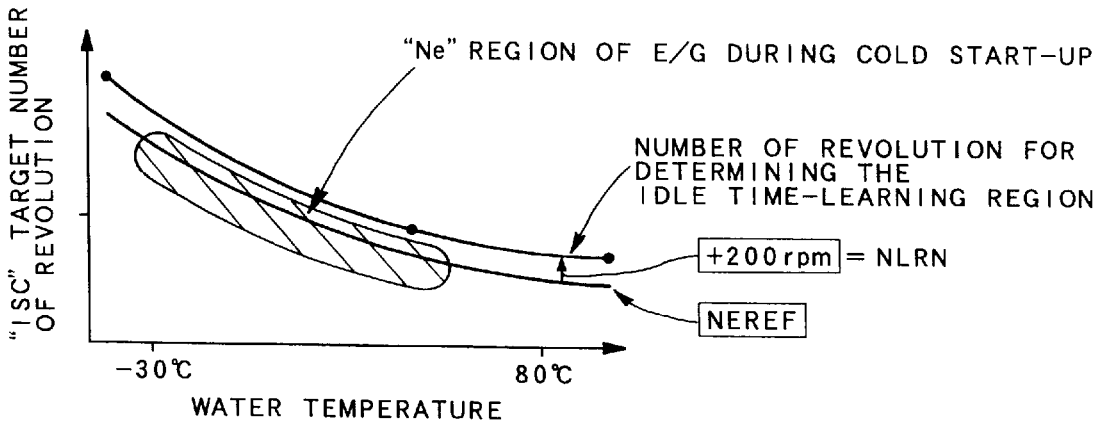
FIG. 8
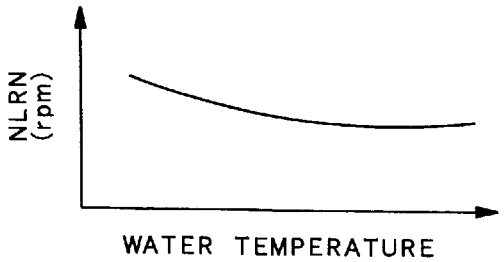

FIG.10
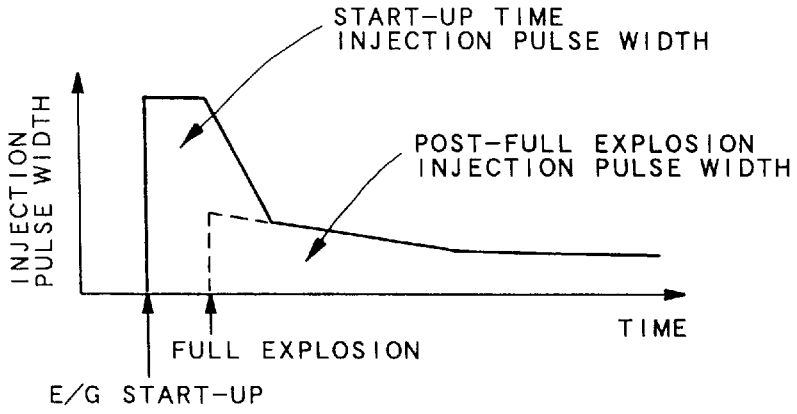
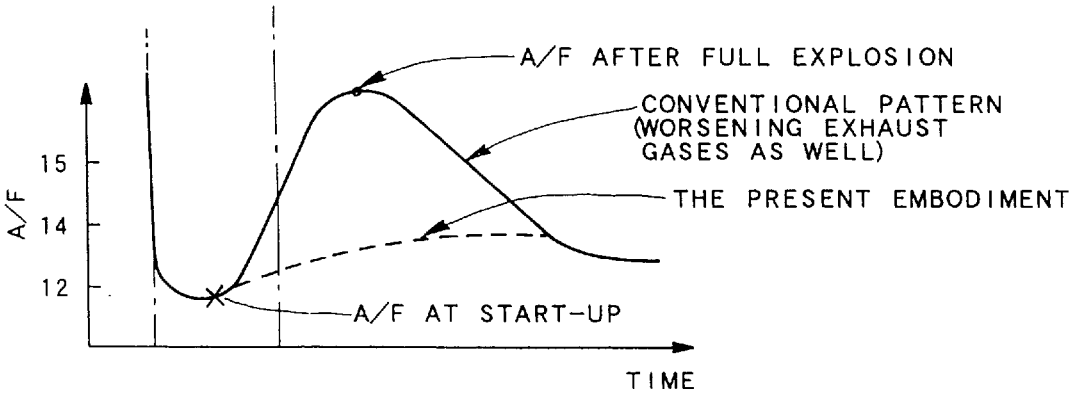
FIG.11
DECELERATION REGION-LEARNING
(1) AIR-CONDITIONER OFF (2) AIR-CONDITIONER ON
| ENGINE LOAD | $Q_{11}$ | $Q_{12}$ | | | $Q_{1n}$ |
|---|---|---|---|---|---|
| AIR-FUEL RATIO LEARNING VALUE | $L_1$ | $L_2$ | | | $L_n$ |

R/L REGION-LEARNING VALUE IS LEARNED ACCORDING TO MAP OF "Ne" AND E/G LOAD $NLRN_1$

SET FOR EACH WATER TEMPERATURE, INDEPENDENTLY OF "ISC" TARGET "Ne"

AIR-FUEL RATIO CONTROLLER FOR INTERNAL COMBUSTION ENGINE

FIELD OF THE INVENTION

This invention relates to an air-fuel ratio controller for an internal combustion engine, including a control means provided with an additional feature for determining whether a rotational engine speed-determining item is satisfied when rotational engine speed is equal to or less than a value obtained by an ISC target rotational speed being added to a predetermined value, the predetermined value including either a fixed value or a variable value, the variable value being by a table versus water temperature, the air-fuel ratio controller being thereby capable of: making an air-fuel ratio correction properly after a start-up explosion in a cylinder; preventing inconveniences such as the occurrence of an engine stall, a decrease in a rotational engine speed, and a discharge of exhaust gases containing harmful components; and, allocating an idle time-learning value with reference to a rotational engine speed that is obtained during engine start-up, resulting in enhanced convenience of use.

BACKGROUND OF THE INVENTION

In some internal combustion engines for vehicles, there is one type of engine which includes a control means for controlling an air-fuel ratio at the time of engine start-up. Such a control means provides air-fuel ratio control during engine start-up in order to prevent the occurrence of an engine stall, or to obviate a needless reduction in rotational engine speed as well as discharge of exhaust gases containing harmful components.

In addition, in some of the above control means, there is a certain type of control means for executing learning control to store values obtained during control operations in order to permit such learning values to be reflected for the next control operation.

One such prior example of an air-fuel ratio controller is disclosed in published Japanese Laid-Open Patent Application No. 5-133262. This controller is designed to execute control according to a detection signal from an exhaust sensor so as to bring an air-fuel ratio into a target value by a correction amount being added to or subtracted from a reference amount of fuel. The air-fuel ratio controller is further designed to save the aforesaid correction amount as a learning value, and then to provide control such that the learning value is reflected in calculating further correction amounts. The air-fuel ratio controller is characterized by a control means whereby, when such a saved leaving value is found, in response to engine start-up, to be a correction amount which must be reduced by a quantity greater than a predetermined level with reference to the reference amount, then control is executed so as to cause the air-fuel ratio to achieve the target value by the step of reducing the saved learning value according to a drop in the temperature of cooling water inside the engine. The result is improved operability during cold start-up operations.

There has been disclosed another prior example in published Japanese Laid-Open Patent Application No. 5-222973. As ISC (idle speed control) valve control method for an engine as disclosed in this publication is characterized by the steps of: determining whether an air-conditioner switch is on when closed loop control is in the process of being executed and further when an engine is in a stationary state; when the air-conditioner switch is on, renewing an air-conditioner-on-learning value using a feedback correction amount that is determined based on a difference between rotational engine speed and idle target rotational speed, the air-conditioner-on-learning value being stored at a predetermined address in a storage means, and when the air-conditioner switch is off, then renewing an air-conditioner-off-learning value by means of the feedback correction amount, the learning value being saved at another predetermined address in the storage means; setting an air-conditioner-on-time-learning value as an initial value of the feedback correction amount when the air-conditioner switch is on immediately after start-up-time control is changed to usual time control, and setting an air-conditioner-off-time-learning value as an initial value of the feedback correction amount when the air-conditioner switch is off; and, correcting a basic characteristic value by means of the feedback correction value, the basic characteristic value being determined based on at least engine temperature, and then setting an opening degree of an ISC valve, the ISC valve being disposed at a location along an air bypass passage, the air bypass passage bypassing a throttle valve. As a result, smooth and successful control switching with improved controllability are attained.

There has been disclosed a further example in published Japanese Laid-Open Patent Application No. 6-249019. An idle controller as taught in this publication includes an idle air quantity-regulating means which is capable of regulating intake air quantity for an internal combustion engine in a non-operated state of an accelerator. As a result, an initial value of the aforesaid intake air quantity immediately after engine start-up is higher than an intake air quantity that is obtained when engine warm-up is completed. Then, after the engine start-up, the idle air quantity-regulating means is controlled so as to reduce the intake air quantity in stages. The idle controller is characterized by: an operation state-detecting means for detecting how the engine is run; a decay degree-determining means whereby it is determined on the basis of an operation state detected by the aforesaid detecting means that an intake air quantity before completion of engine warm-up decays to a higher degree with a greater rise in temperature of the engine; and, an idle air quantity control means for controlling the aforesaid idle air quantity-regulating means according to an intake air quantity that is damped and then determined according to a degree of decay. As a result, the intake air quantity during engine start-up is caused to decay according to a state in which the engine is run.

In conventional air-fuel ratio controllers, an idle-learning region condition for learning control has been established, as illustrated in FIG. 15. More specifically, as can be seen from FIG. 15, the following is established as components of the aforesaid idle-learning region condition: to determine whether an idle switch (IDSW) is on/off; to compare a rotational engine speed (Ne) with a fixed value of 1,000 rpm; and, to determine whether an air-conditioner switch (A/C SW) is on/off. Then, the idle-learning region condition is fulfilled when: the idle switch (IDSW) is on; the engine speed (Ne) is equal to or less than the fixed value of 1,000 rpm; and, the air-conditioner switch (A/C SW) is off.

However, there have been drawbacks that occur with learning control under such a conventional idle-learning region condition:

(1) An engine load during cold start-up in a state of an internal combustion engine being cold is designated as area 300 in FIG. 15. This area overlaps with another area of an engine load (referred to as R/L load) when the vehicle is travelling in a state of the engine being warmed up.

(2) In the case of the above (1), a fuel-learning value obtained during vehicle travel, not during idling, enters a start-up injection pulse as a correction when the engine is started in a cold state.

(3) For a fuel-learning value during vehicle travel and, in particular, a fuel-learning value during vehicle travel in the present system, the learning control is executed, even when a purge valve is on. Such a learning value is corrected so as to dilute fuel when the vehicle runs at an elevated altitude or temperature, and, in particular when gasoline vapor occurs in larger amounts.

(4) In the above cases of (1) through (3) above, the engine is turned off, and is then cooled down in a state of the learning value being corrected to provide diluted gasoline. Accordingly, when the engine is again started, then an air-fuel ratio at the engine start-up is corrected to be a leaner ratio. As a result, the engine speed is reduced, or in some instances an engine stall occurs. (See FIGS. 16 and 17.)

In addition, since such a conventional idle time-learning region condition does not include a vehicle velocity-determining item, then deceleration of the engine causes the idle switch to be turned on, even when the vehicle is travelling.

As a result, deviation in an air-fuel ratio during the engine deceleration is recorded as an air-fuel ratio-learning value during idle operation, and then an idle-learning value is erroneously learned. This causes inconveniences, namely one factor contributing to a variation in an air-fuel ratio after a full explosion, and another factor contributing to an incorrect air-fuel ratio during idle operation.

SUMMARY OF THE INVENTION

In order to obviate or minimize the aforesaid drawbacks, the present invention provides an air-fuel ratio controller for an internal combustion engine including a control means for executing idle time air-fuel ratio-learning control in order to record a learning value when an idle time-learning region condition is satisfied, the idle time-learning region condition including an idle switch-on-determining item and a rotational engine speed-determining item, the improvement wherein the control means is provided with an additional feature whereby it is determined, in executing the rotational engine speed-determining item, that the rotational engine speed-determining item is fulfilled when a rotational engine speed is equal to or less than a value obtained by addition of an ISC target rotational speed and a predetermined value, the predetermined value including either a fixed value or a variable value, the variable value being mapped on a table versus water temperature.

According to the invention having the above features, in executing the rotational engine speed-determining item, the control means determines that the rotational engine speed-determining item is fulfilled when a rotational engine speed is equal to or less than a value obtained by an ISC target rotational speed being added to a predetermined value, the predetermined value including either a fixed value or a variable value, the variable value being mapped on a table versus water temperature. As a result, an air-fuel ratio correction is made properly after an engine start-up explosion. In addition, drawbacks of the conventional air fuel control devices, such as the occurrence of an engine stall, a decrease in engine rotational speed, and a discharge of exhaust gases containing harmful components, are precluded. Further, an idle time-learning value is allocated with reference to a rotational engine speed that is obtained during engine start-up.

BRIEF DESCRIPTION OF THE DRAWINGS

FIG. 6 is an illustration showing idle time air-fuel ratio-learning, in which data (1) is given when an air conditioner is off, while data (2) is obtained when the air conditioner is on;

FIGS. 7 and 8 are illustrations showing an idle time-learning region condition;

FIG. 10 shows two time charts at the time of engine start-up;

FIG. 11 is an illustration showing deceleration region-learning, in which data (1) is given when an air conditioner is off, while data (2) is given when the air conditioner is on;

DETAILED DESCRIPTION

Figure 1:
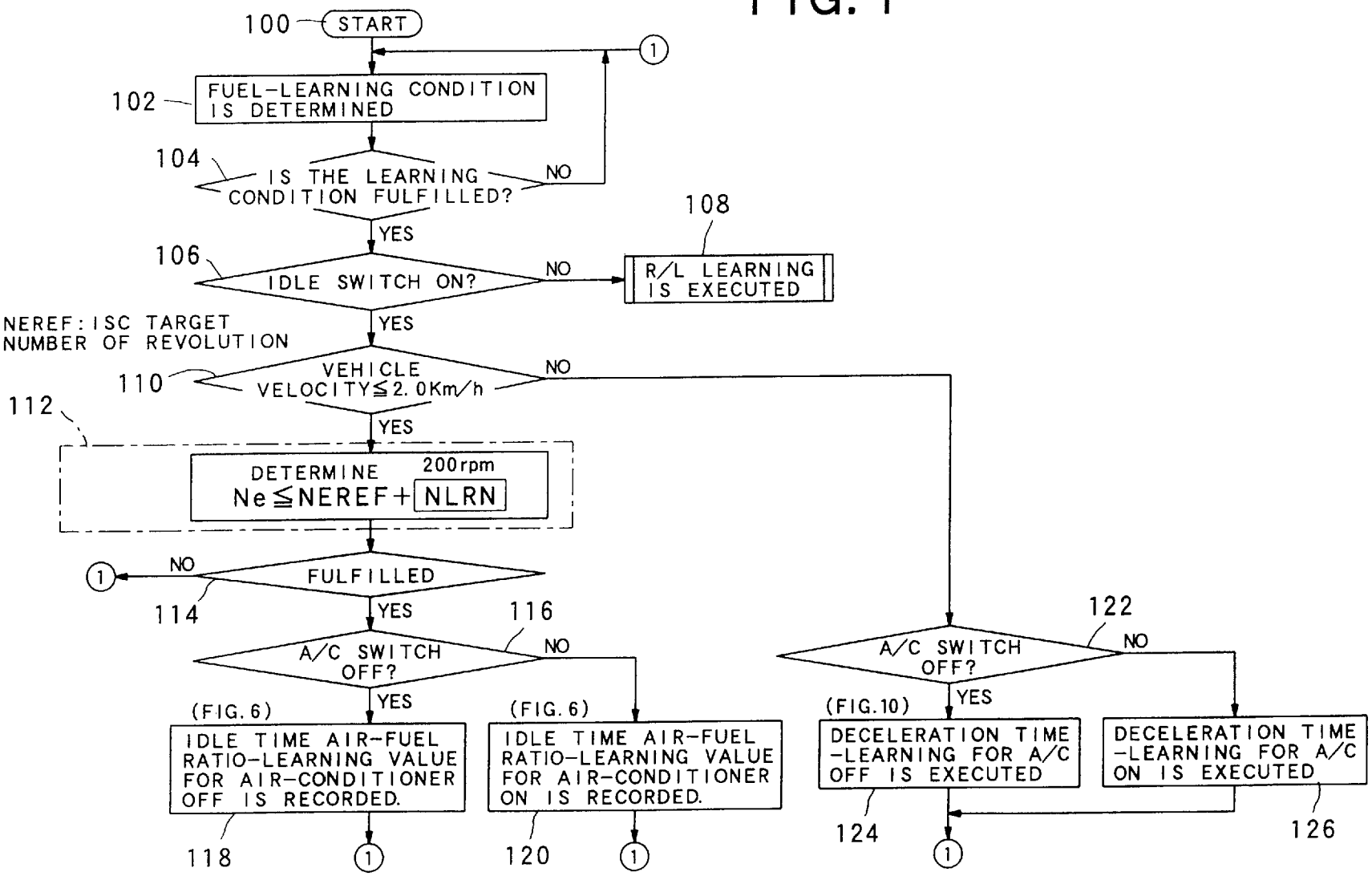
FIG. 1 is a flow chart for air-fuel ratio-learning control which is provided by an air-fuel ratio controller for an internal combustion engine according to an embodiment of the present invention.
Figure 2:
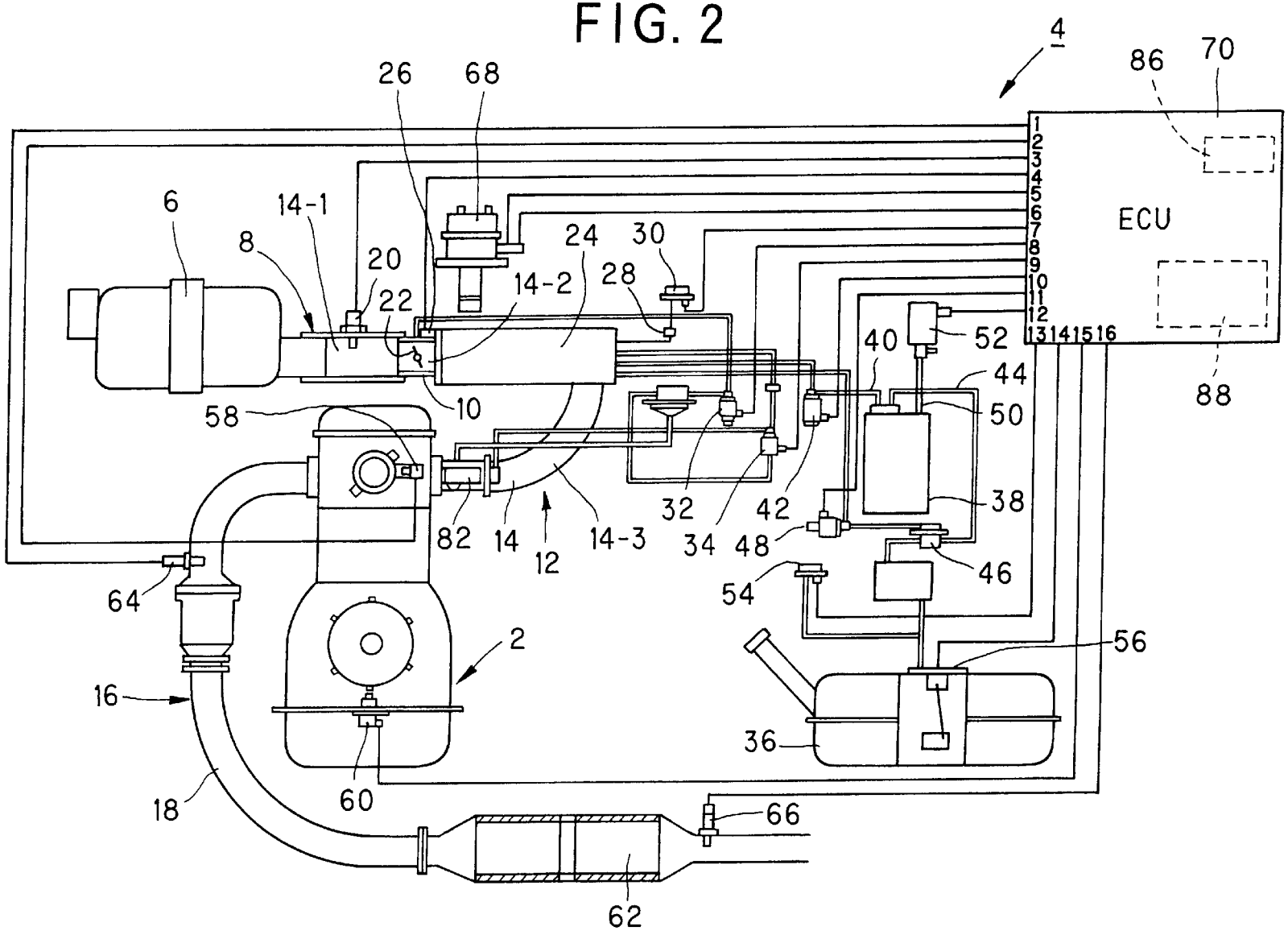
FIG. 2 is a schematic structural view illustrating the air-fuel ratio controller and engine.

FIGS. 1–12 illustrate one embodiment of the invention. In FIG. 2, reference numeral 2 denotes an internal combustion engine; 4 an air-fuel ratio controller; 6 an air cleaner; 8 an intake pipe; 10 a throttle body; 12 an intake manifold; 14 an intake passage; 16 an exhaust pipe; and 18 an exhaust passage.

The intake pipe 8 is disposed between the air cleaner 6 and the throttle body 10 to form a first intake passage 14-1. An intake temperature sensor 20 is positioned on the upstream side of the intake pipe 8 for detecting intake air temperature.

The throttle body 10 has a second intake passage 14-2 formed therein which communicates with the first intake passage 14-1. An intake throttle valve 22 is disposed in the second intake passage 14-2. The second intake passage 14-2 communicates with a third intake passage 14-3 through a surge tank 24. The third intake passage 14-3 is defined in the intake manifold 12. The third intake passage 14-3 on the downstream side thereof communicates with a combustion chamber (not shown) of the engine 2 through an intake valve (not shown). The combustion chamber communicates with the exhaust passage 18 through an exhaust valve (not shown).

In addition, a throttle opening sensor 26 is disposed in the throttle body 10 for detecting throttle opening degree of the intake throttle valve 22. Further, the surge tank 24 is provided with an intake pipe pressure sensor 30 for detecting intake pipe pressure through a filter 28.

The engine 2 is provided with an EGR control valve 32 for exhaust gas recirculation, and with a further valve 34 for use in determining exhaust gas recirculation (EGR).

The engine 2 is further provided with a fuel tank 36. A canister 38 is disposed between the fuel tank 36 and an intake system of the engine 2. The surge tank 24 and the canister 38 communicate with one another through a purge passage 40, and a duty valve 42 for purging is positioned substantially midway along the purge passage 40. The canister 38 and fuel tank 36 communicate with one another through an evaporation passage 44. A pressure valve 46 is disposed substantially midway along the evaporation passage 44. A pressure valve control valve 48 is provided in communication with the pressure valve 46.

Yet further, the canister 38 is provided with an atmosphere opening passage 50. An atmosphere opening control valve 52 is positioned substantially midway along the passage 50.

The fuel tank 36 is provided with an internal fuel tank pressure sensor 54 and a level gauge 56. The sensor 54 detects the internal pressure of the tank 36. The level gauge 56 detects fuel quantity inside the tank 36.

The engine 2 is provided with a water or coolant temperature sensor 58 and a crankshaft angle sensor 60. The former sensor 58 detects the temperature of cooling water in the engine 2. The latter sensor 60 detects a crank rotational angle of a crankshaft.

The engine 2 also has a catalytic convertor 62 positioned substantially midway along the exhaust passage 18. In addition, a front oxygen sensor 64 and a rear oxygen sensor 66 are arranged substantially midway along the exhaust passage 18, but the front sensor 64 is located on the upstream side of the catalytic convertor 62, while the rear sensor 66 is positioned on the downstream side of the catalytic converter 62.

Further, the following are separately connected to a control means (preferably an electronic control unit, (ECU) 70: the intake temperature sensor 20 and the throttle opening sensor 26; the intake pipe pressure sensor 30; the EGR control valve 32; the valve 34 for EGR determination; the duty valve 42 for purging the canister; the pressure valve control valve 48; the atmosphere control valve 52; the internal fuel tank pressure sensor 54; the level gauge 56; the water temperature sensor 58; the crank angle sensor 60; the front oxygen sensor 64; the rear oxygen sensor 66; and, a distributor 68. The control means 70 may be a suitable integrated circuit providing the required control steps.

Figure 3:
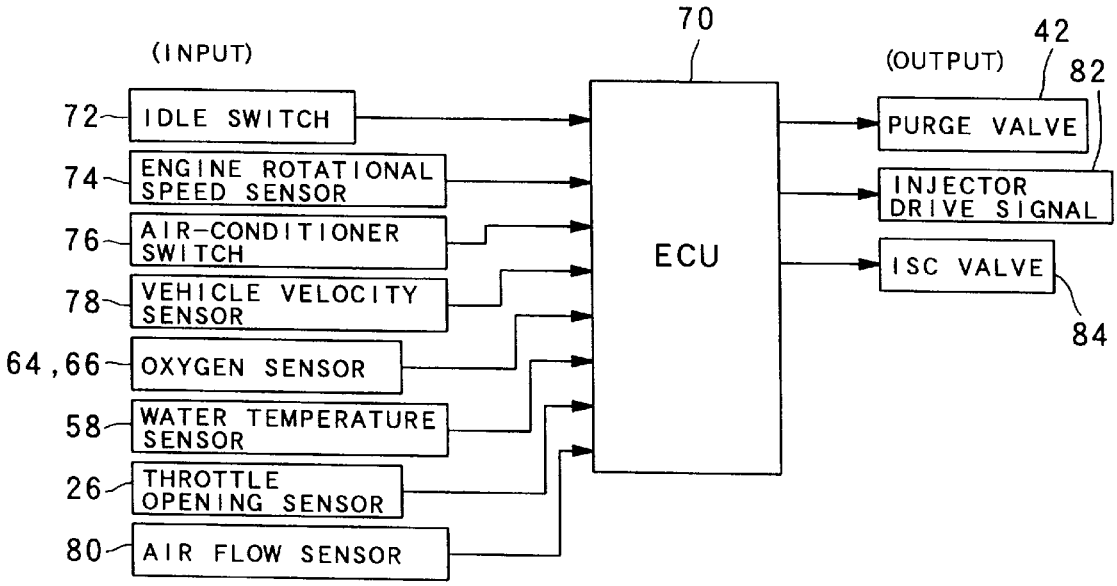
FIG. 3 is a schematic block view illustrating the air-fuel ratio controller.

As shown in FIG. 3, at least the following signals enter the control means 70: an ON-OFF signal from an idle switch 72; a detection signal from a rotational engine speed sensor 74; an ON-OFF signal from an air-conditioner switch 76; a detection signal from a vehicle velocity sensor 78; respective detection signals from the front and rear oxygen sensors 64, 66; a detection signal from the water temperature sensor 58; a detection signal from a throttle opening sensor 26; and a detection signal from an air flow sensor 80. Meanwhile, the following signals leave the control means 70: a drive signal for the purge valve, i.e., the duty valve 42; a drive signal for an injector 82; and a drive signal for ISC (idle speed control) valve 84.

The control means 70 executes idle time air-fuel ratio learning control so as to record a learning value when idle time-learning region conditions are satisfied, whereby an air-fuel ratio of the engine 2 is controlled. To this end, the control means 70 includes an atmospheric pressure sensor 86 and a memory for recording the learning value.

Further, the control means 70 is provided with an additional feature whereby it is determined, in executing a rotational engine speed determining item of the idle time-learning region condition, that the rotational engine speed determining item is satisfied when rotational engine speed "Ne" is equal to or less than a value obtained by addition of "NEREF" and "NLRN". "NEREF" is an ISC target rotational speed. "NLRN" is a predetermined value which consists of either a fixed value or a variable value, the latter value being mapped on a table dependent on water temperature.

Figure 5:
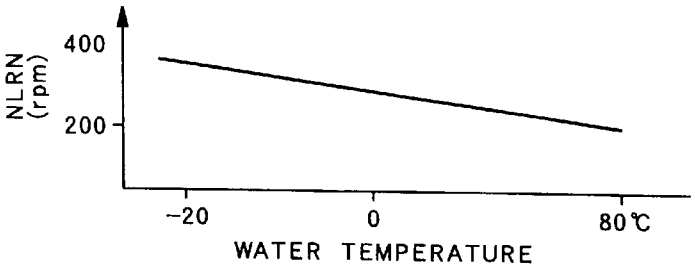
FIG. 5 is a graph showing predetermined value "NLRN"

More specifically, as illustrated in FIG. 5, "NLRN" can be selected from one of a fixed value of, e.g. 200 rpm, and a variable value which is set on the table for each water temperature.

When a relationship between "Ne" and the value obtained by "NEREF" being added to "NLRN" is established by the equation $Ne \leqq NEREF+NLRN$, then the control means 70 determines that the rotational engine speed-determining item has been satisfied.

The control means 70 has a fuel-learning condition and the idle time-learning region condition.

Figure 4:
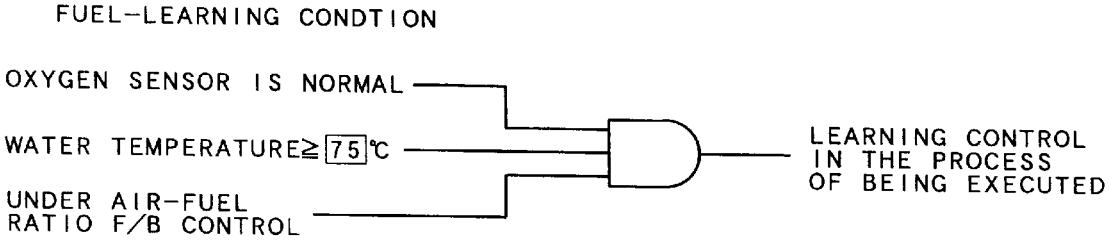
FIG. 4 is an illustration showing a fuel-learning condition.

As illustrated in FIG. 4, the fuel-learning condition is met, thereby practicing learning control when all of the following states occur: the front and rear oxygen sensors 64, 66 are in a normal state; water temperature is equal to or greater than a given temperature, e.g. 75 degrees centigrade; and air-fuel feedback (F/B) control is in the process of being executed.

As illustrated in FIGS. 7 and 8, the idle time-learning region condition includes: an idle switch-on-determining item; the rotational engine speed-determining item; an air-conditioner (A/C) switch-off-determining item; and a vehicle velocity-determining item. Therefore, the idle time-learning region condition is satisfied when all of the following states occur: the idle switch is on; "Ne" is equal to or less than the value obtained by addition of "NEREF" and "NLRN"; the air-conditioner (A/C) switch is off; and, the vehicle velocity is equal to or less than a given velocity, e.g., 2.0 Km/h.

In the vehicle velocity-determining item of the idle time-learning region condition, the control means 70 further includes an additional feature whereby the idle time air-fuel ratio learning control is executed when the vehicle velocity is equal or less than a predetermined vehicle velocity of 2.0 Km/h, while deceleration region-learning control is performed when the vehicle velocity exceeds the same vehicle velocity.

As illustrated in FIG. 6, referring to the air-conditioner (A/C) switch-"OFF"-determining item in the idle time air-fuel ratio learning control, when the air-condition (A/C) switch is off, then respective learning values $IL_1$, $IL_2$ are stored in the memory 88 of the control means 70 after engine loads $Q_1$, $Q_2$ are interpolated and calculated according to engine load measurements, e.g. intake air quantities. Similarly, when the air-condition (A/C) switch is on, then respective learning values $IL_3$ are saved in different areas of the memory 88 after engine loads Qn are interposed and calculated according to engine leads, e.g. the intake air quantity. Thus, each learning value is stored at a different address in the memory.

As illustrated in FIG. 11, referring to the air-conditioner (A/C) switch "OFF" determining item in executing the deceleration region learning control, respective learning values $L_1$, $L_2$ . . . Ln are stored in the memory 88 in a manner similar to the idle time air-fuel ratio-learning control at different memory addresses based on engine loads $Q_{11}$, $Q_{12}$, . . . $Q_{1n}$.

Further, the control means 70 provides fuel control according to an injection pulse width upon engine start-up, while executing the fuel control according to a post-full explosion injection pulse width after a full explosion. The control means 70 determines the presence/absence of the engine load after the idle time-learning region condition is met, and then provides idle time correction control so as to reflect respective learning values that are recorded dependent on the presence/absence of the engine load.

The control means 70 determines the presence/absence of the engine load when the vehicle velocity-determining item is not satisfied because a vehicle velocity is greater than a given vehicle velocity. Then, the control means 70 provides deceleration time correction control so as to reflect respective learning values which are saved depending upon the presence/absence of the engine load.

Figure 15:
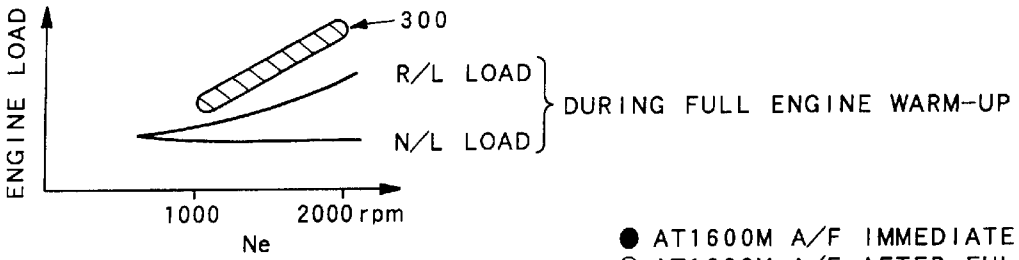
FIG.15 PRIOR ART
FIG. 15 is an illustration showing an idle time-learning region condition according to the prior art; and, FIGS. 16 and 17 are illustrations showing a relationship between an air-fuel ratio (A/F) and a learning value.
Figure 16:
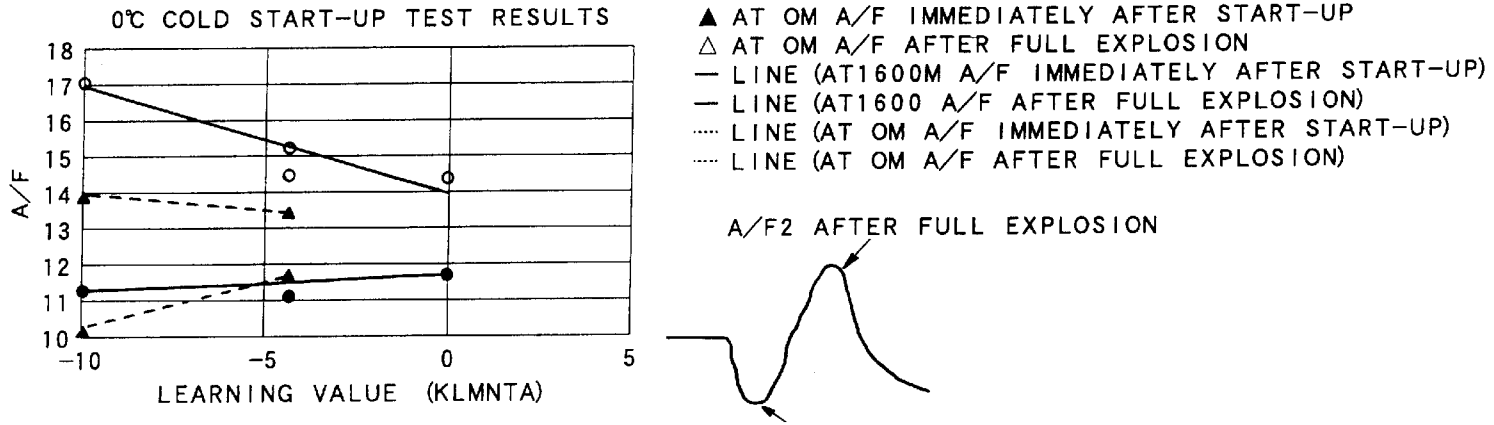
Figure 17:
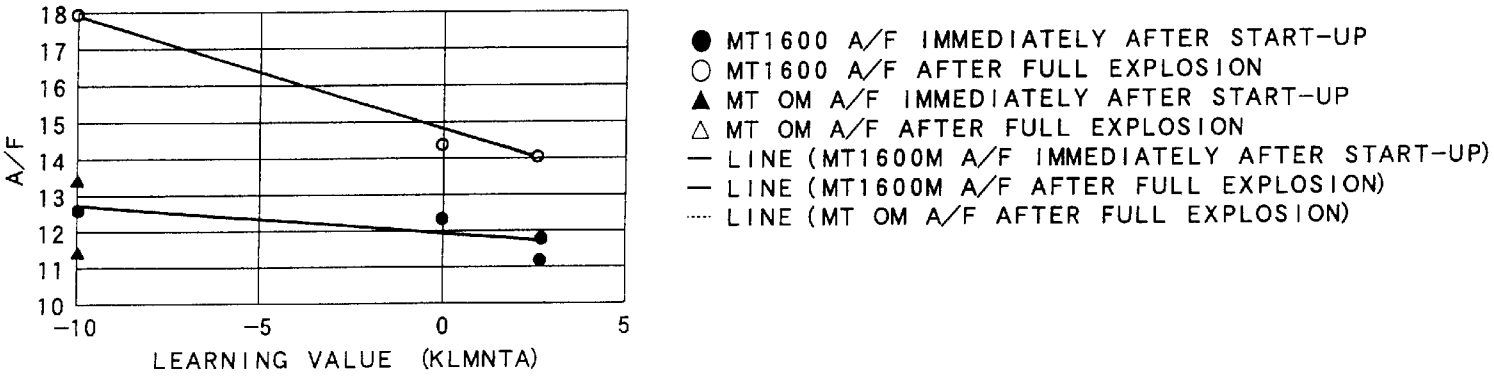

In conclusion, pursuant to the present embodiment, in the rotational engine speed-determining item of the idle time-learning region condition, a "Ne" region covered or upwardly bounded by "NLRN" added to "NEREF" is an idle-learning region, as shown in FIG. 7. As a result, when an engine load during cold engine start-up lies within the region 300 in FIG. 15 as seen in the prior art, then a correction is made based on a learning value that is obtained during idle operation.

The operation of the present embodiment will now be described with reference to the FIG. 1 flow chart for air-fuel ratio-learning control.

When the control program is started (100), the routine is advanced to a step of determining a fuel-learning condition (102), at which a determination is made as to whether the fuel-learning condition is fulfilled (104).

When the determination (104) results in "NO", then the routine is returned to the previous step (102). When the same determination (104) results in "YES", then a determination is made as to whether the idle switch is on (106).

When the determination (106) results in "NO", i.e., the idle switch is off, then the routine is shifted to a step of executing R/L learning (108). Such R/L learning execution (108) is learning control of a running engine by the vehicle control means and lies out of the range of the present invention, a detailed description thereof is omitted. When the above determination (106) results in "YES", i.e., the idle switch is on, then the routine advances to a step of determining whether a vehicle velocity is equal to or less than 2.0 Km/h (110).

When the above determination (110) results in "YES", then the routine is moved to a rotational engine speed-determining item (112), at which a determination is made as to whether a relationship between rotational engine speed "Ne" and a value obtained by addition of ISC target rotational speed "NEREF" and a predetermined value "NLRN" is established by the equation $Ne \leqq NEREF+NLRN$, that is, whether the condition is satisfied (114). When the determination (114) is "NO", then the routine is returned to the previous step (102). However, when the same determination (114) results in "YES", then the routine is advanced to a step of determining whether the air-conditioner switch is off (116).

When the determination (116) results in "YES", then an idle time air-fuel ratio learning value for the air-conditioner switch being off is recorded, as illustrated in FIG. 6 (118). After the learning value is saved, the routine is returned to step 102. However, when the above determination (116) is "NO", then an idle time air-fuel ratio learning value for the air-conditioner switch being on is recorded, as illustrated in FIG. 6 (120). After the learning value is stored, the routine is returned to step 102.

In the aforesaid step of determining whether the vehicle velocity is equal to or less than 2.0 Km/h (110), when the determination (110) results in "NO", then a determination is made as to whether the air-conditioner switch is off (122). When the determination (122) is "YES", then deceleration time-learning for the air-conditioner switch being off is executed, as illustrated in FIG. 11 (124). However, when the same determination (122) results in "NO", then deceleration time-learning for the air-conditioner switch being on is executed, as illustrated in FIG. 11 (126). After the learning value is stored, the routine is returned to step 102.

Figure 9:
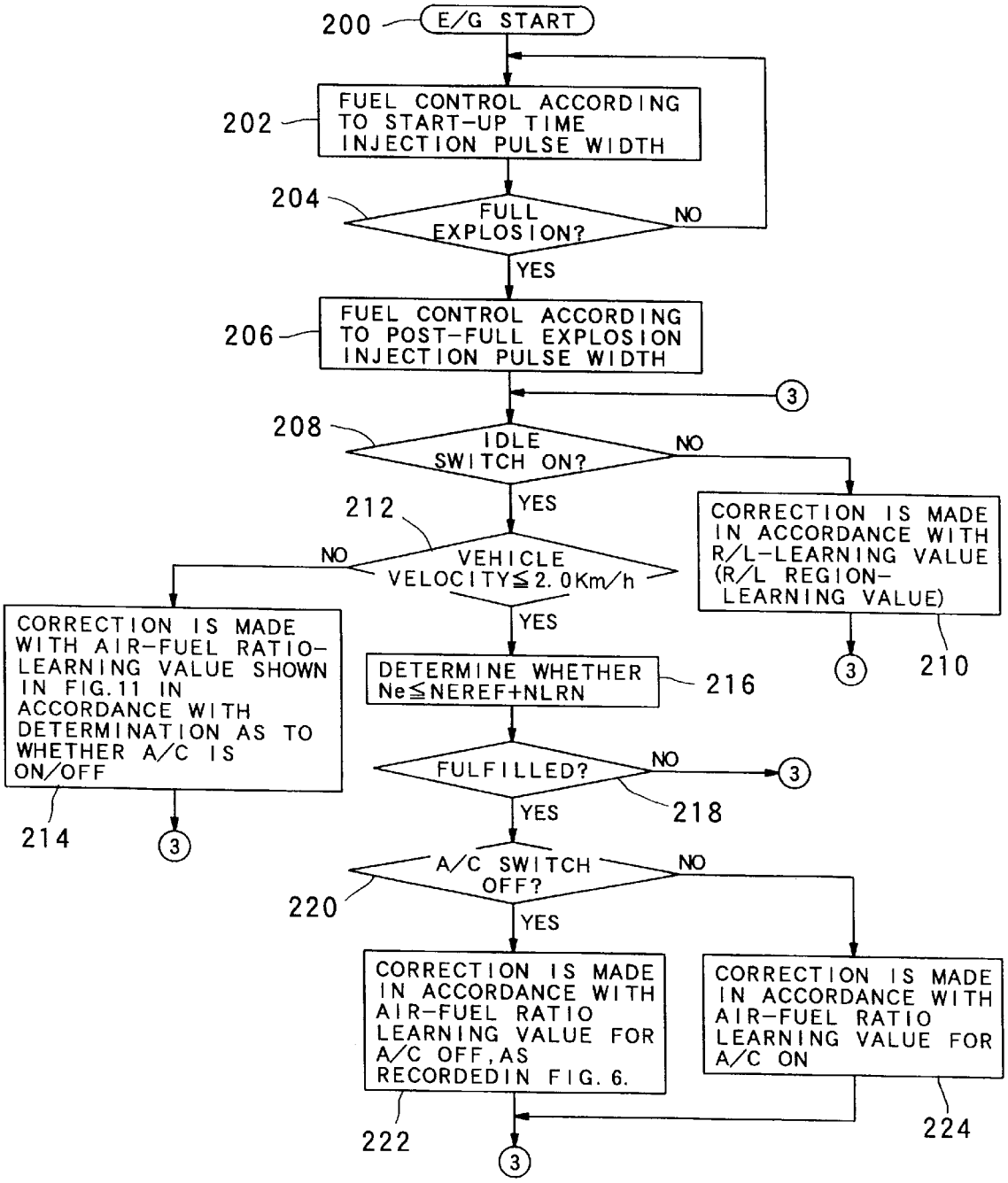
FIG. 9 is a flow chart for learning value-reflecting control at the time of engine start-up.
Figure 12:
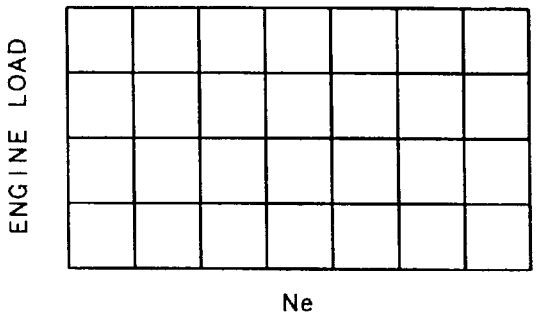
FIG. 12 is a map showing a relationship between an engine load and rotational engine speed "Ne"

Further descriptions will now be provided with reference to the flow chart of FIG. 9 for learning value reflecting control at the time of engine start-up.

When the engine (E/G) 2 starts (step 200), then fuel control is executed according to a start-up time injection pulse width (202), at which a determination is made as to whether the engine 2 provides a full explosion (204) as shown in FIG. 10.

When the determination (204) results in "NO", then the routine is returned to the previous stage (202). When the same determination (204) is "YES", then the fuel control is executed according to a post-full explosion injection pulse width after a full explosion (206). Further, the post-full explosion injection pulse width equals a basic pulse width times an open loop learning correction factor times air-fuel ratio feedback (FR) correction factor times the sum of one plus an air-fuel ratio correction factor.

Thereafter, a determination is made as to whether the idle switch is on (208). When the determination (208) results in "NO", then a correction is made according to a R/L-learning value (also referred to as "R/L region-learning value") (210). Then, the routine is returned to the previous step (208). However, when the above determination (208) is "YES", then a determination is made as to whether a vehicle velocity is equal to or less than 2.0 Km/h (212).

When the determination (212) results in "NO", then a correction is made with the air-fuel ratio learning value as illustrated in FIG. 11 in accordance with a determination of the air-conditioner switch being on/off. Then, the routine is returned to the prior stage (208). However, when the above determination (212) results in "YES", then the routine is advanced to the rotational engine speed-determining item (216), at which a determination is made as to whether a relationship between rotational engine speed "Ne" and a value obtained by addition of ISC target rotational speed "NEREF" and a predetermined value "NLRN" is established as $Ne \leqq NEREF+NLRN$, that is, whether the equation is satisfied (218).

When the above determination (218) is "NO", then the routine is returned to the prior stage (208). However, when the same determination (218) results in "YES", then a determination is made as to whether the air-conditioner switch is off (220). When the determination (220) is "YES", then a correction is made according to an air-fuel ratio learning value for the air-conditioner switch being off, as recorded in FIG. 6 (222). However, when the above determination (220) results in "NO", then similarly a correction is made according to an air-fuel ratio-learning value for the air-conditioner switch being on (224). Thereafter, the routine is returned to prior stage (208).

In conclusion, the control means 70 includes the function of determining whether the rotational engine speed-determining item is fulfilled when "Ne" is less than or equal to the value of "NEREF" added to "NLRN"; and, such function of the control means 70 allows an air-fuel ratio correction to be made properly after an engine start-up explosion, as illustrated in FIG. 10. This feature makes it possible to preclude inconveniences such as the occurrence of an engine stall, a reduced engine rotational speed, and a discharge of exhaust gases containing harmful components. This is advantageous in view of practical use.

In addition, since "NLRN" includes either an invariable value or a variable value that is established on a table for various water temperatures, then an idle time-learning value can be allocated with reference to a rotational engine speed that is obtained during engine start-up. This feature prevents usage inconvenience.

Further, since the vehicle velocity-determining item is added to the idle time-learning region condition, then it is possible to preclude prior inconveniences such as the occurrence of an engine stall, a reduction in an engine rotational speed, and a discharge of exhaust gases containing harmful components. Yet further, an idle-learning correction after a full explosion as well as during engine start-up can be made within fine limits, with a consequential prevention against similar inconveniences such as a reduction in rotational speed or a discharge of exhaust gases containing harmful components after engine warm-up.

Turning now to the vehicle velocity-determining item of the idle time-learning region condition, when a vehicle velocity is equal to or less than a predetermined vehicle velocity of 2.0 Km/h, then the idle time air-fuel ratio-learning control is executed, while the deceleration region-learning control is practiced when the vehicle velocity exceeds the aforesaid predetermined velocity. This feature provides the enhanced accuracy of the air-fuel ratio control in the internal combustion engine, and thus enables a greater reduction in exhaust gases which contain harmful components. This is advantageous in view of practical use.

In addition, even when the idle switch is on, the learning values are selectively used to make a correction, depending upon the presence of the vehicle velocity (see FIG. 11) and the absence of the vehicle velocity (see FIG. 6). As a result, an air-fuel ratio can properly be corrected within very fine limits according to the respective operating states.

Further, since demand for an air-fuel ratio varies according to idle, deceleration, and R/L, depending upon the air-conditioner being on/off, then learning is executed separately so as to reflect the need for various learning values. As a result, an air-fuel ratio correction is achievable within finer limits.

Yet further, for each engine load under respective conditions as illustrated in FIGS. 6 and 11, learning is executed for the reflection of the learning values during idle and deceleration. As a result, the air-fuel ratio control is achievable within much finer limits.

It is to be noted that the present invention is not limited to the aforesaid embodiment, but is susceptible to various changes and modifications.

Figure 13:
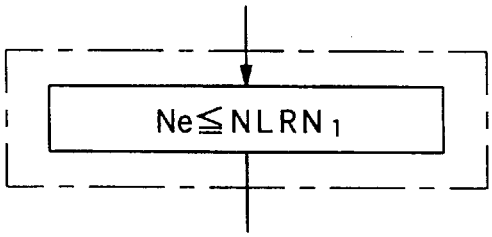
FIG. 13 is only an essential portion of a flow chart for air-fuel ratio-learning control, which is provided by an air-fuel ratio controller according to another embodiment.
Figure 14:
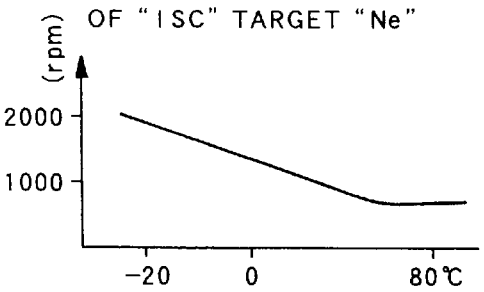
FIG. 14 is an illustration showing predetermined value "NLRN1"

For example, "NLRN" according to the aforesaid embodiment includes either a fixed value of 200 rpm or a variable value which is set on a table for each water temperature, as illustrated in FIG. 5. However, as illustrated in FIGS. 13 and 14, a predetermined value "NLRN1" can be set for each water temperature, independently of ISC target rotational speed "NEREF", thereby determining whether the following relationship is established:

$$Ne \leqq NLRN1$$

As a result, an idle time-learning value can be allocated with reference to a rotational engine speed that is obtained during engine start-up. FIG. 13 may replace step 112 in FIG. 1. This feature enhances convenience of use.

As amplified in the above description, pursuant to the present invention, there is provided an air-fuel ratio controller for an internal combustion engine, including a control means for executing idle time air-fuel ratio learning control in order to record a learning value when an idle time-learning region condition is satisfied, the idle time-learning region condition including an idle switch-on-determining item and a regional engine speed-determining item, the improvement wherein the control means is provided with an additional feature whereby it is determined, in executing the rotational engine speed-determining item, that the rotational engine speed-determining item is fulfilled when a rotational engine speed is equal to or less than a value obtained by an ISC target rotational speed being added to a predetermined value, the predetermined value including either a fixed value or a variable value, the variable value being mapped on a table for each water temperature. As a result, an air-fuel ratio correction can be made properly after a start-up explosion. In addition, it is possible to eliminate prior inconveniences such as the occurrence of an engine stall, a decrease in an engine rotational speed, and a discharge of exhaust gases containing harmful components. Further, since the aforesaid predetermined value includes either an invariable value or a variable value that is mapped on a table for various water temperatures, then an idle time-learning value can be allocated with reference to a rotational engine speed that is obtained at the time of engine start-up. As a result, enhanced convenience of use is achievable.

Although a particular preferred embodiment of the invention has been disclosed in detail for illustrative purposes, it will be recognized that variations or modifications of the disclosed apparatus, including the rearrangement of parts, lie within the scope of the present invention.

What is claimed:

1. In an air-fuel ratio controller for an internal combustion engine, including a control means for executing idle time air-fuel ratio-learning control in order to record a learning value when an idle time-learning region condition is satisfied, said idle time-learning region condition including an idle switch-on-determining item and a rotational engine speed-determining item, the improvement wherein said control means determines, in executing said rotational engine speed-determining item, that said rotational engine speed-determining item is fulfilled when a rotational engine speed is equal to or less than a value obtained by addition of an ISC target rotational speed and a predetermined value, said predetermined value including one of a fixed value and a variable value, said variable value being mapped on a table for each water temperature, wherein said control means has an idle switch-on-determining item, a rotational engine speed-determining item, and a vehicle velocity-determining item, and wherein said control means executes idle time air-fuel ratio-learning control when a vehicle velocity is equal to or less than a predetermined vehicle velocity, while performing deceleration region-learning control when the vehicle velocity exceeds the predetermined vehicle velocity.

2. An air-fuel ratio controller for an internal combustion engine according to claim 1, wherein said control means provides fuel control according to an injection pulse width upon engine start-up, while executing fuel control according to a post-full explosion injection pulse width after a full explosion, and wherein said control means determines the presence/absence of an engine load after an idle time-learning region condition is satisfied, said idle time-learning region condition including said idle switch-on-determining item and said rotational engine speed-determining item, and then said control means provides idle time correction control so as to reflect respective learning values that are recorded dependent on the presence of the engine load.

3. An air-fuel ratio controller for an internal combustion engine according to claim 1, wherein said control means provides fuel control according to an injection pulse width upon engine start-up, while executing fuel control according to a post-full explosion injection pulse width after a full explosion, and wherein said control means determines the presence/absence of an engine load after said idle time-learning region condition is satisfied, said idle time-learning region condition including said idle switch-on-determining item, said rotational engine speed-determining item, and said vehicle velocity-determining item, and then said control means provides idle time correction control so as to reflect respective learning values that are recorded dependent on the presence/absence of the engine load, and further wherein said control means determines the presence/absence of the engine load when said vehicle velocity-determining item is unsatisfied because actual vehicle velocity is greater than the predetermined vehicle velocity, and then said control means provide deceleration time correction control so as to reflect respective learning values which are saved dependent on the presence/absence of the engine load.

4. A method for controlling the learning air-fuel ratio in an idling internal combustion engine, comprising the steps of:

storing variable values in a memory table versus engine coolant temperature;

determining whether the idle switch is on;

determining vehicle velocity;

determining whether vehicle velocity is equal to or less than a predetermined vehicle velocity;

performing deceleration region-learning control when vehicle velocity exceeds the predetermined vehicle velocity;

determining whether engine speed is equal to or less than the sum of an idle speed control target value and a predetermined value; and prior to the preceding determining step determining the predetermined value from at least one of a fixed value and one variable value based on engine coolant temperature.

5. The method according to claim 4, further comprising the steps of:

determining absence of engine load after the determining steps of whether the idle switch is on and the engine speed is equal to or less than the sum of the idle speed control target value and the predetermined value, and correcting idle time control based on recorded learning values learned during presence of engine load.

6. The method according to claim 4, further comprising the steps of:

determining whether the absence of engine load occurs while the vehicle velocity is greater than the predetermined vehicle velocity, and correcting deceleration time control based on recorded learning values learned during one of presence and absence of engine load.

7. In an air-fuel ratio controller for an internal combustion engine, including a control means for executing idle time air-fuel ratio-learning control in order to record a learning value when an idle time-learning region condition is satisfied, said idle time-learning region condition including an idle switch-on-determining item and a rotational engine speed-determining item, the improvement wherein said control means determines, in executing said rotational engine speed-determining item, that said rotational engine speed-determining item is fulfilled when rotational engine speed is equal to or less than a value obtained by addition of an ISC target rotational speed and a predetermined value, said predetermined value including one of a fixed value and a variable value, said variable value being mapped on a table for each water temperature and wherein said control means provides fuel control according to an injection pulse width upon engine start-up, while executing fuel control according to a post-full explosion injection pulse width after a full explosion, and wherein said control means determines the presence/absence of an engine load after said idle time-learning region condition is satisfied, said idle time-learning region condition including said idle switch-on-determining item and said rotational engine speed-determining item, and then said control means provides idle time correction control so as to reflect respective learning values that are recorded dependent on the presence of the engine load.

* * * * *